US007284548B2

(12) United States Patent
Matsuda

(10) Patent No.: US 7,284,548 B2
(45) Date of Patent: Oct. 23, 2007

(54) CUTTING METHOD BY WIRE SAW AND CUT WORKPIECE RECEIVING MEMBER IN WIRE SAW

(75) Inventor: Takeharu Matsuda, Nara-ken (JP)

(73) Assignee: Takatori Corporation, Nara-ken (JP)

( * ) Notice: Subject to any disclaimer, the term of this patent is extended or adjusted under 35 U.S.C. 154(b) by 0 days.

(21) Appl. No.: 11/637,118

(22) Filed: Dec. 12, 2006

(65) Prior Publication Data

US 2007/0131213 A1 Jun. 14, 2007

(30) Foreign Application Priority Data

Dec. 12, 2005 (JP) ..... 2005-357636

(51) Int. Cl.
*B28D 1/08* (2006.01)

(52) U.S. Cl. ..... 125/17; 125/21; 451/305; 269/909

(58) Field of Classification Search ..... 451/305, 451/296; 269/43, 50, 51, 58, 909; 125/16.01, 125/17, 21, 35
See application file for complete search history.

(56) References Cited

U.S. PATENT DOCUMENTS 3,889,699 A * 6/1975 Ranieri ..... 125/16.01
6,419,779 B1 * 7/2002 DePetrillo et al. ..... 156/254

* cited by examiner

*Primary Examiner*—Jacob k. Ackun, Jr.
(74) *Attorney, Agent, or Firm*—Wenderoth, Lind & Ponack, L.L.P.

(57) ABSTRACT

In a cutting method by a wire saw, in which a wire A at a wire array wound around work rollers 10 is made to reciprocate or travel in one direction at a high speed and numerous pieces of wafers are cut out in abutment of a workpiece B against the wire array, a receiving member 27 of a cassette type having numerous support wires 34 arranged at the same pitch as that of the wire at the wire array is disposed at a position immediately under the wire array for cutting the workpiece B; and wafers b cut out of the workpiece B by the wire A are contained in separation one from another between the support wires 34 in the receiving member 27. Thus, the wafers can be prevented from adhering to each other during a cutting operation, thus to be accurately cut, and further, the wafers can be prevented from being cracked during the cutting operation, thus to be efficiently separated one from another, so as to enhance wafer cleansing performance.

2 Claims, 7 Drawing Sheets

(a)

(b)

(a)

(b)

(c)

CUTTING METHOD BY WIRE SAW AND CUT WORKPIECE RECEIVING MEMBER IN WIRE SAW

BACKGROUND OF THE INVENTION

1. Field of the Invention

The invention relates to a cutting method by a wire saw and a cut workpiece receiving member in a wire saw and, more particularly, to a method for separating cut workpieces one from another during a workpiece cutting operation by a wire saw and a receiving member for favorably receiving the cut workpieces in separation one from another.

2. Description of the Related Art

In a wire saw, a wire reeled out from a feed side real is introduced to a tension mechanism and a load cell for measuring tension via a traverser and a guide pulley; and then, is wound numerous times around at least two work rollers, thereby forming a wire array; and finally, is wound around a retrieving side reel.

The above-described wire at the wire array across the work rollers is made to reciprocate or travel in one direction at a high speed, so that the workpiece is cut out into numerous wafers at the same time in abutment of the workpiece against the wire array while supplying, to the wire array, a slurry liquid containing a hard abrasive grain made of SiC or diamond or a water-soluble slurry liquid for the purpose of easy cleansing. Incidentally, a wire having diamond grains secured thereto via a resin or the like may be used.

Although a demand for cutting a workpiece such as, in particular, a silicon ingot for a solar cell has been increased in recent years in cutting the workpiece by the wire saw, as described above, a wafer thickness of 200 μm or less has been required for the purpose of cost reduction, thereby spurring more thinness.

As described above, as the thickness immediately after the cutting operation becomes smaller, it becomes difficult to handle a wafer after the cutting operation, thereby raising a problem of reduction of yield due to a crack of a wafer till a next cleansing process.

In a conventional workpiece cutting method by a wire saw, a workpiece B made of silicon or an ingot is adhesively secured to a workpiece machining mount 51 via a dummy member 52 constituted of a carbon or glass plate, as shown in FIG. 9A, and then, the workpiece B is pressed toward a wire A at a wire array, to be thus cut down to the dummy member 52, as shown in FIG. 9B. As a consequence, the workpiece B is cut in a comb-like state, so that wafers b are cut out.

Therefore, the wafers b cut out by the wire saw are preliminarily cleansed in the comb-like state, in which the wafers b are adhesively bonded to the dummy member 52 used in cutting, thereby removing the slurry liquid (i.e., a grinding liquid) 53. Subsequently, the bonded portions between the wafers b and the dummy member 52 are peeled off or are manually peeled off one by one, so that the wafers b are separated one from another.

However, a clearance equivalent to the diameter of the wire being, for example, 160 μm or lately 80 μm is undesirably formed between the wafers in the method for cutting the workpiece in the comb-like state. The slurry liquid stays in the clearance, and then, the surface tension of the slurry liquid narrows the clearance. Therefore, an outermost one out of the wafers b cut out in a thickness of about 100 μm is markedly curved and flexed, as shown in FIG. 9B, thereby raising a problem that the wafer weighted down with the slurry liquid 53 breaks and falls even with the application of a slight vibration.

In addition, since the cut-out wafers b remain bonded to the dummy member 52 in the method for cutting the workpiece into the comb-like shape, the workpiece is lifted up after the cutting operation, to be thus required to be drawn from the wire A. At this time, there arises a problem of the contact of the cut surface of the wafer with the wire, thereby exerting a flaw at the cut surface of the wafer.

In order to solve the above-described problems caused by cutting the workpiece into the comb-like shape, there has been proposed a cutting method for separating a plurality of wafers one from another, wherein a workpiece is fixed to a workpiece fixing table for fixing the workpiece with a space defined between facing surfaces of a dummy member secured to the workpiece fixing table and another dummy member secured to the workpiece, the dummy member on the workpiece side also is cut down to the space together with the workpiece at the same time, the wafer is separated from the dummy member on the workpiece fixing table side by the effect of the space upon completion of the cutting operation, and then, the wafer falling down by the cutting operation is received by a workpiece receiver (for example, see Japanese Patent Application Laid-open (JP-A) No. 2000-326324).

In the method in which the wafer falling down upon completion of the cutting operation is received by the workpiece receiver, a wire is positioned at a terminal end of the workpiece while a cutting start end of the workpiece becomes free as the wafer cutting operation approaches the final stage, so that the cutting start ends of the wafer are brought into contact with each other by the surface tension of a slurry liquid.

If the cutting operation proceeds in the above-described state, in particular, by using a wire saw of a down-cut type for cutting the wafer by pressing the workpiece from above a wire array, the cut and separated wafer is accidentally brought again into contact with an adjacent wafer during the falling caused by the surface tension of the slurry liquid. The plurality of wafers in contact with each other may be cracked even with the application of a slight vibration during the cutting operation owing to its own weight and the weight of the slurry liquid. Otherwise, the numerous wafers may be cracked if they fall at one time. As a consequence, there arises a problem of marked degradation of yield.

Furthermore, the contact between the ends of the wafers during the cutting operation undesirably flexes the wafer during the cutting operation, thereby degrading cutting accuracy. Moreover, the falling wafer leaning against the adjacent wafer may crack or deform the adjacent wafer by the weight of the leaning wafer.

Additionally, the surface tension of the slurry liquid need be broken in order to cleanse the wafers adhering to each other by the surface tension. Therefore, a considerably strong cleansing force is required, thereby arising a problem of the fracture of the wafer. Alternatively, the requirement of the strong cleansing force raises a problem from the viewpoint of environment or a cost. Furthermore, since the wafer is reduced in thickness, the wafer may be broken during a manually peeling operation, in particular.

Moreover, when the space is defined between the dummy members in fixing the workpiece to the workpiece fixing table, the workpiece is vibrated during the cutting operation by the use of the wire, thereby making it difficult to accurately cut the wafer.

SUMMARY OF THE INVENTION

The invention has been accomplished to solve the above-described problems experienced in the prior art. Therefore, an object of the invention is to provide a cutting method by a wire saw and a cut workpiece receiving member in the wire saw, in which wafers can be prevented from adhering to each other during a cutting operation, thus to be accurately cut out; the wafers can be prevented from being cracked during the cutting operation, thus to be efficiently separated one from another, so as to enhance wafer cleansing performance; and a cost can be reduced during the cleansing operation.

In order to solve the above-described problems, in a cutting method according to the invention, in which a wire array is formed by winding a wire around at least two work rollers numerous times, the wire at the wire array is made to reciprocate or travel in one direction at a high speed, and the workpiece is cut into numerous pieces of wafers in abutment of the workpiece against the wire array, a receiving member having numerous partition members arranged at the same pitch as that of the wire at the wire array is disposed at a position immediately under the wire array for cutting the workpiece; and the cut workpieces cut out of the workpiece by the wire are contained in separation one from another between the partition members in the receiving member.

Furthermore, in a cut workpiece receiving member according to the invention, in which a wire array is formed by winding a wire around at least two work rollers numerous times, the wire at the wire array is made to reciprocate or travel in one direction at a high speed, and the workpiece is cut into numerous pieces of wafers in abutment of the workpiece against the wire array, the receiving member is provided at a position immediately under the wire array for cutting the workpiece, for containing the cut workpieces cut out of the workpiece by the wire in separation one from another; wherein the receiving member is formed by winding the same number of support wires at the same pitch as those of the wires at the wire array in the wire saw between a plurality of groove rollers-mounted on a bottom plate; and wherein the receiving member is disposed under the wire array for cutting the workpiece such that the support wires are located immediately under the wires at the wire array.

Three out of the plurality of groove rollers may be arranged in a laterally triangular shape on the bottom plate, and portions above and under the support wires wound around the three groove rollers may be inversely inclined.

Here, the receiving member is of a cassette type, which is detachably attached to the wire saw, and further, the support wire wound across the groove rollers has the same diameter of that of the wire in the wire saw.

The wafers cut by the wire array in the wire saw are contained, from the tip on the cut side thereof, between the support wires located immediately under the wafers, so that the deformation of the wafer due to the flexure can be prevented, and further, the adjacent wafers are separated one from another without any adhesion to each other. The cut wafer can be drawn from the wire saw together with the receiving member.

Since in the wire saw according to the invention, the receiving member having the numerous partition members arranged at the same pitch as that of the wire at the wire array is disposed at the position immediately under the wire array for cutting the workpiece, and further, the cut workpieces cut out of the workpiece by the wire are contained in separation one from another between the partition members in the receiving member. As a consequence, since the wafers cut by the wire array in the wire saw are contained, from the tip on the cut side thereof, between the partition members located immediately under the wafers, the deformation of the wafer due to the flexure can be prevented, thus enhancing the cutting accuracy and securely separating the wafers one from another without any adhesion of the adjacent wafers to each other via the slurry liquid.

Additionally, the separation of the cut wafers one from another can prevent any crack on the wafer caused by the falling upon the completion of the cutting operation or any adhesion of the wafers to each other in the contained state, can make it easy to cleanse the wafer or handle the wafer, and further, can prevent any breakage of the wafer during the separation of the cut wafers one from another.

In addition, since the three out of the groove rollers in the cut workpiece receiving member are arranged in the laterally triangular shape on the bottom plate and the portions above and under the support wires wound around the three groove rollers are inversely inclined, the tips of the cut wafers can be introduced into the receiving member under the sequential guidance by the support wire, so that the wafers can be securely contained in the receiving member in the separation one from another.

DETAILED DESCRIPTION OF THE PREFERRED EMBODIMENT

A detailed description of a preferred embodiment according to the invention will be given below in reference to the attached drawings.

Figure 1:
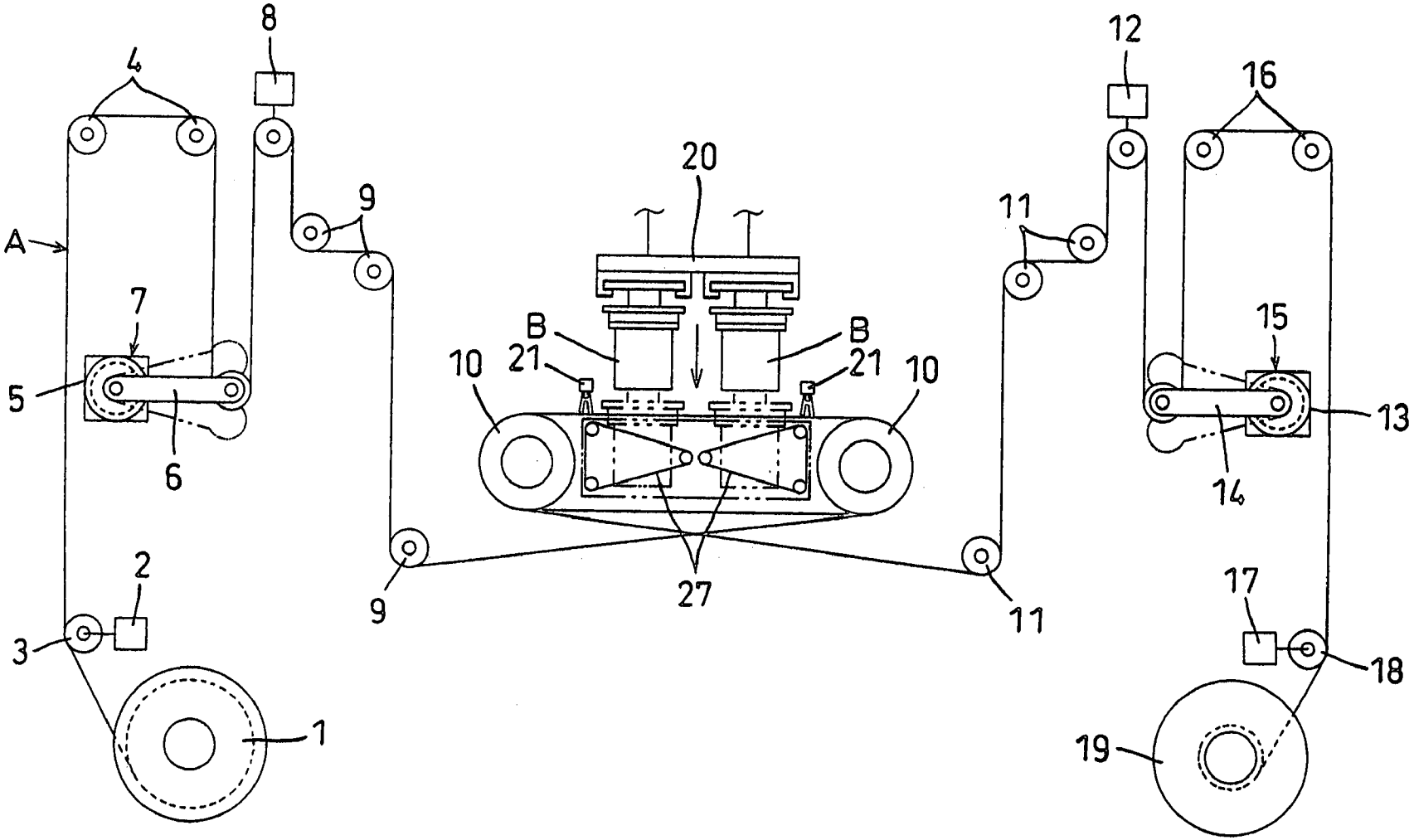
FIG. 1 is a front view showing the entire structure of a wire saw.

FIG. 1 shows the entire structure of a wire saw. A wire A drawn from a feed side real 1 is adapted to be introduced through a feed side traverser 3 to be driven by a motor 2, a tension mechanism 7 including an encoder 5 and a tension arm 6 via a plurality of guide pulleys 4, a load cell 8 for measuring the tension of the wire A and a plurality of guide pulleys 9; to form a wire array by winding numerous times across a pair of work rollers 10 juxtaposed on both sides at a predetermined interval; and thereafter, to be wound around a retrieving side reel 19 through a plurality of guide pulleys 11, another load cell 12 for measuring the tension of the wire A, another tension mechanism 15 including an encoder 13 and a tension arm 14, a plurality of guide pulleys 16, and another retrieving side traverser 18 to be driven by another motor 17.

A workpiece fixing table 20 is disposed immediately above an upper wire array wound across the work rollers 10 in such a manner as to be vertically moved by appropriate drive means, not shown, and is designed to depress workpieces B fixed to the lower surface of the workpiece fixing table 20.

The wire A at the wire array across the work rollers 10 is made to reciprocate or travel in one direction at a high speed owing to rotational drive by the appropriate drive means, not shown, in the work rollers 10, and then, the workpiece B is pressed against the wire array while supplying, through grinding liquid nozzles 21, a slurry liquid containing hard abrasive grains of SiC or diamond or a water-soluble slurry liquid, which makes it easy to cleanse the workpiece, thus cutting out the workpiece B in numerous pieces of wafers at the same time. Incidentally, the wire A may have diamond grains secured thereto via a resin or the like. In this case, cooling water, a lubricant and the like may be used in place of the slurry liquid.

In fixing the workpiece B to the workpiece fixing table 20 for fixing the workpiece B thereto, a machining mount 22 is disposed under the workpiece fixing table 20 in such a manner as to be adjustably positioned, and further, a dummy member 23 consisting of a carbon or glass plate and a dummy member 24 similar to the dummy member 23 are secured to the lower surface of the machining mount 22 and the upper surface of the workpiece B via an adhesive agent 25, respectively, as shown in FIGS. 2 and 7A to 7C. Moreover, the lower surface of the dummy member 23 and the upper surface of the dummy member 24 are brought into tight contact with each other, wherein both of the dummy members 23 and 24 are secured to each other via the adhesive agent 25 out of the range of the workpiece B.

Figure 7:
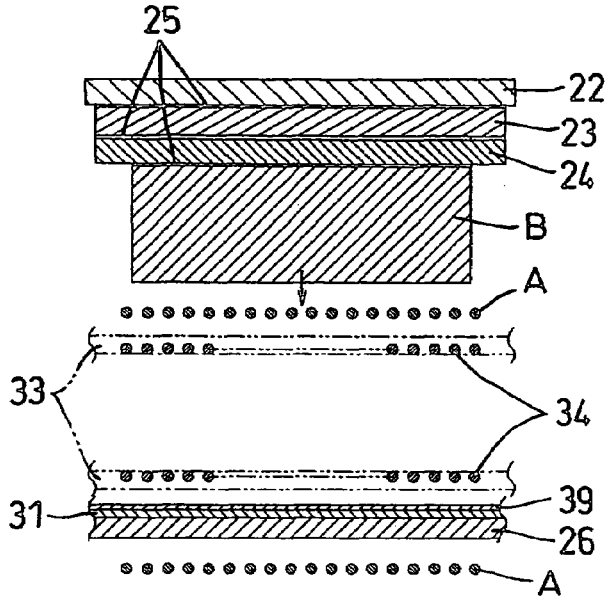
FIGS. 7A to 7C are side views showing the sequence of workpiece cutting processes, taken along a line VII-VII of FIG. 2.
Figure 7:
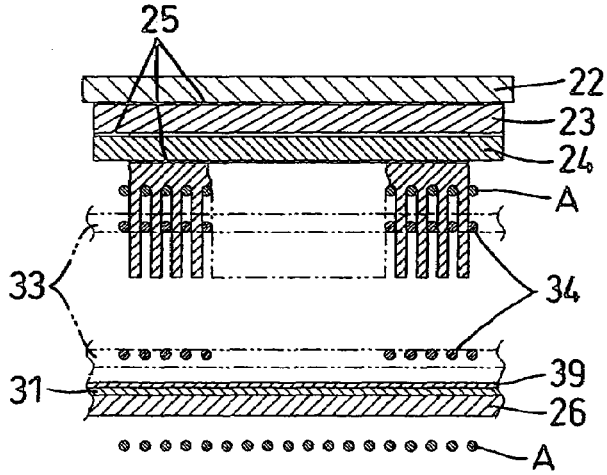
Figure 7:
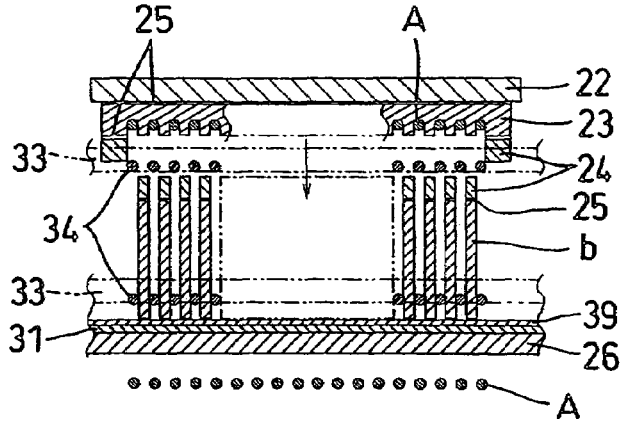

When the workpiece B is fixed in the above-described manner, three constituent elements, that is, the machining mount 22 and the dummy members 23 and 24 are brought into tight contact with each other, thereby effectively preventing any occurrence of vibrations at the workpiece B during the workpiece cutting operation. Here, FIGS. 7A to 7C show the constituent elements in enlargement for the sake of easy understanding.

In the illustration, since the two machining mounts 22 are juxtaposed under the workpiece fixing table 20 and have the workpieces B disposed thereunder, the two workpieces B are cut at the same time. One machining mount 22 is disposed, and therefore, one workpiece B may be cut.

In the above-described wire saw, a fixing frame 26 having a horizontal portion on a lower side between the wire arrays located above and under across both of the work rollers 10. In the meantime, receiving members 27 for containing cut workpieces b (hereinafter referred to as "wafers") in separation, which are cut out of the workpiece B and separated one from another by means of the wire A, are disposed in a removable cassette manner under the upper wire array for cutting the workpiece B on the fixing frame 26.

As shown in the drawings, the two receiving members 27 are disposed under the wire array in such a manner as to be positioned immediately under the two workpieces B, respectively, in the wire saw for cutting the two workpieces B at the same time.

As shown in FIGS. 2 to 6, the fixing frame 26 is disposed such that both ends along the axial direction of the workpiece roller 10 are securely disposed to a vertical machine table 28 for supporting a shaft 10*a* for transmitting drive force to the workpiece roller 10 and a support plate 30 having a portion pivoting the tip of the workpiece roller 10 covered with a cover 29. In the receiving member 27, cassette side plates 32 are erected at both ends of a cassette bottom plate 31 placed on the fixing frame 26, a plurality of groove rollers 33 parallel to the workpiece roller 10 are disposed across both of the cassette side plates 32, and further, support wires 34 serving as partition members are wound around a group consisting of the groove rollers 33.

The receiving member 27 is brought at one end thereof into contact with a reference plate 35 provided for determining a reference position at one end at the upper surface of the fixing frame 26, and thereafter, the receiving member 27 is securely positioned with accuracy at the upper surface of the fixing frame 26 by a positioning member 36 fitted at the other end of the reference plate 35 and at the other end of the fixing frame 26. Therefore, the receiving member 27 can be detached from the fixing frame 26 by releasing the positioning member 36 in this cassette system.

The number of above-described groove rollers 33 used herein is three. The groove rollers 33 are disposed across the cassette side plate 32 in a laterally isosceles triangle. The support wire 34 is wound around the group consisting of the groove rollers 33 the same times at the same pitches as those of the wire A at the upper wire array in the wire saw. The receiving member 27 is located under the wire array for cutting the workpiece B while being positionally fixed to the fixing frame 26 such that the support wire 34 is located immediately under the wire A at the wire array.

The above-described support wire 34 has the same diameter as that of the wire A in the wire saw. Grooves have been previously formed around the groove roller 33 in the same number and at the same pitches as those of the wire array, so that the support wire 34 is wound around the group consisting of the groove rollers 33 along the grooves by appropriately using a winder.

Incidentally, although the diameter of the support wire 34 is set to be equal to that of the wire A in the wire saw in the above-described embodiment, a support wire 34 having a diameter different from that of the wire A in the wire saw may be used so as to enhance the supporting or separating performance with respect to the cut wafer b.

The support wire 34 is disposed in the laterally isosceles triangle in the receiving member 27, and therefore, the support wire 34 is vertically located in an inversely inclined manner. As a consequence, the respective tips of the cut wafers b are introduced into the receiving member 27 under the sequential guidance by the support wire 34, so that the cut wafers b can be securely contained in separation from each other.

Figure 2:
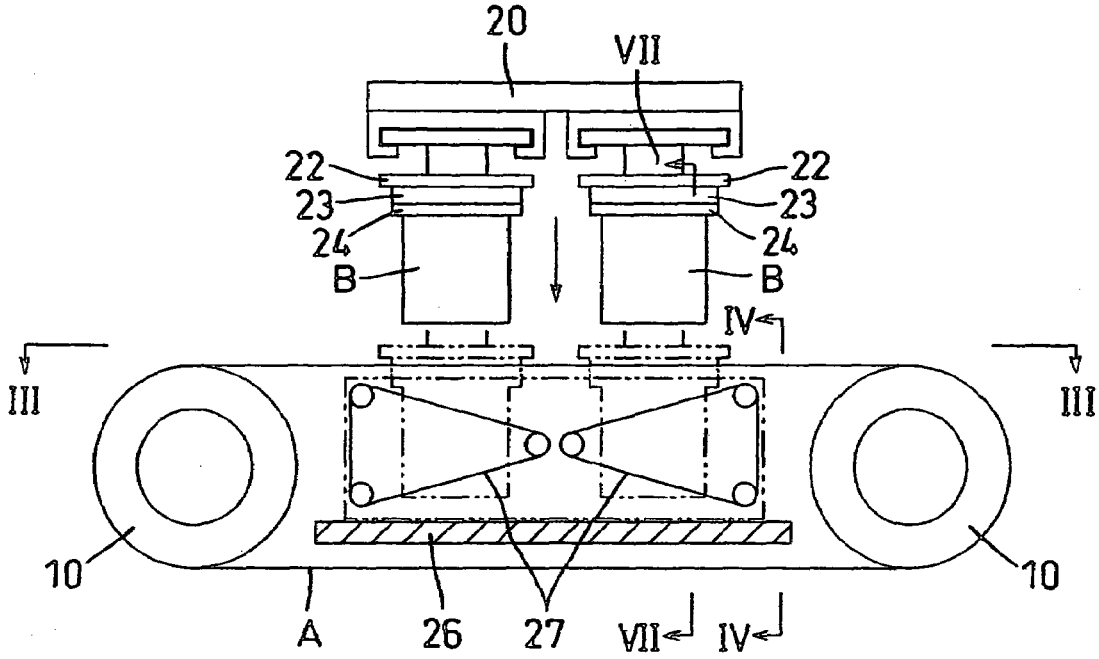
FIG. 2 is a vertically front view showing essential parts of the wire saw in enlargement.
Figure 3:
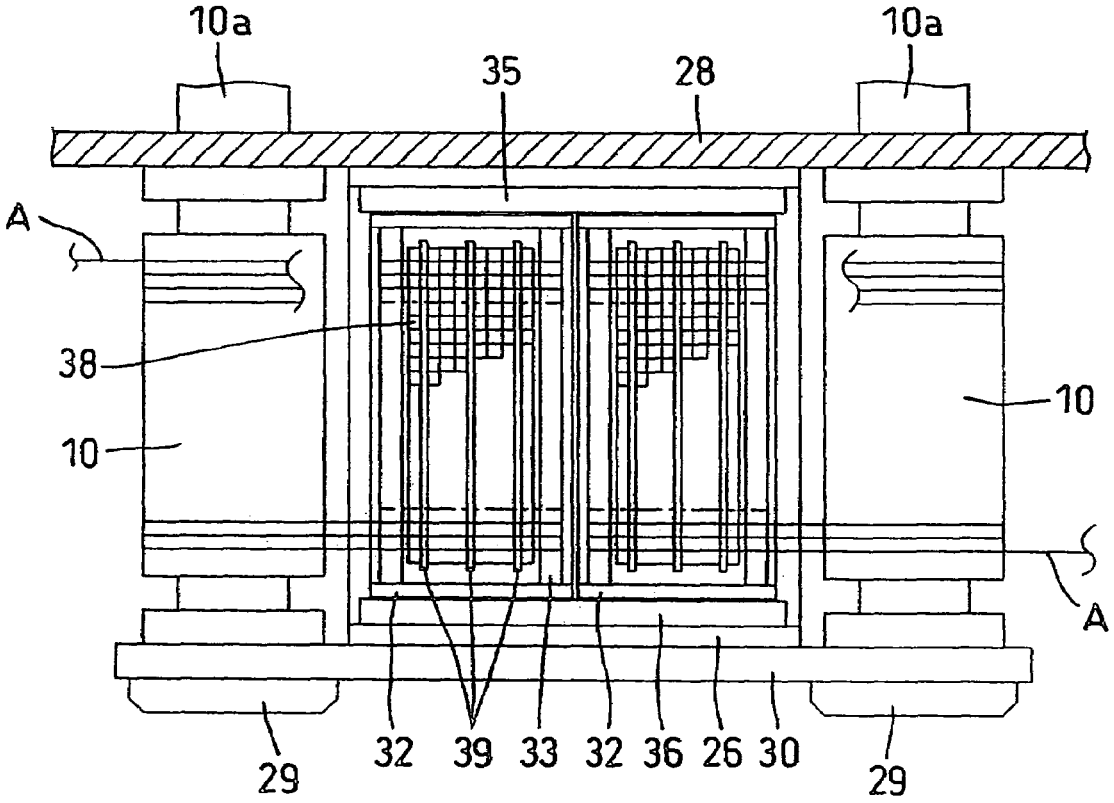
FIG. 3 is a plan view showing the essential parts of the wire saw in enlargement, taken along a line III-III of FIG. 2.
Figure 4:
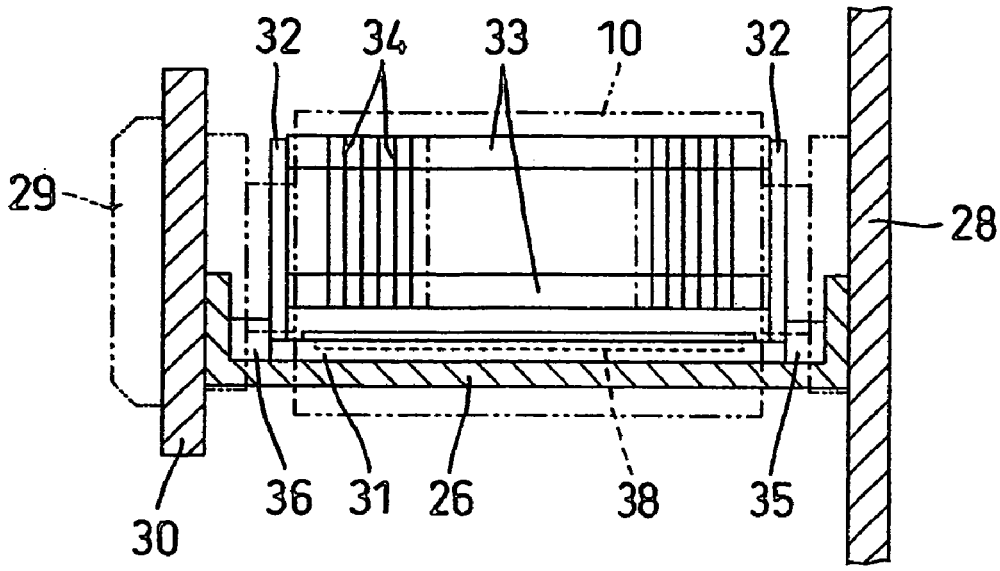
FIG. 4 is a side view showing the arrangement of a receiving member, taken along a line IV-IV of FIG. 2.
Figure 5:
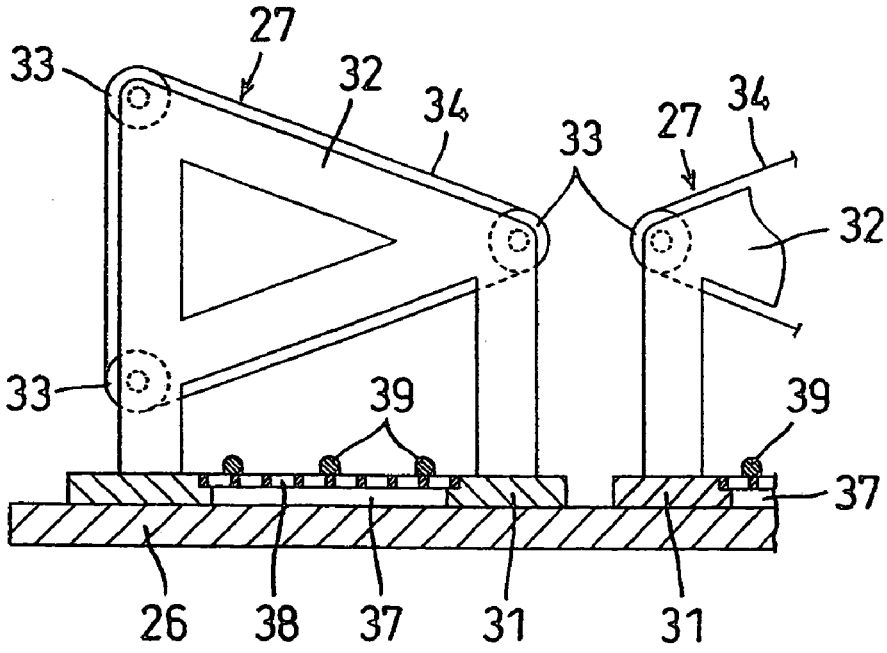
FIG. 5 is a vertically front view showing the arrangement of the receiving member in enlargement.
Figure 6:
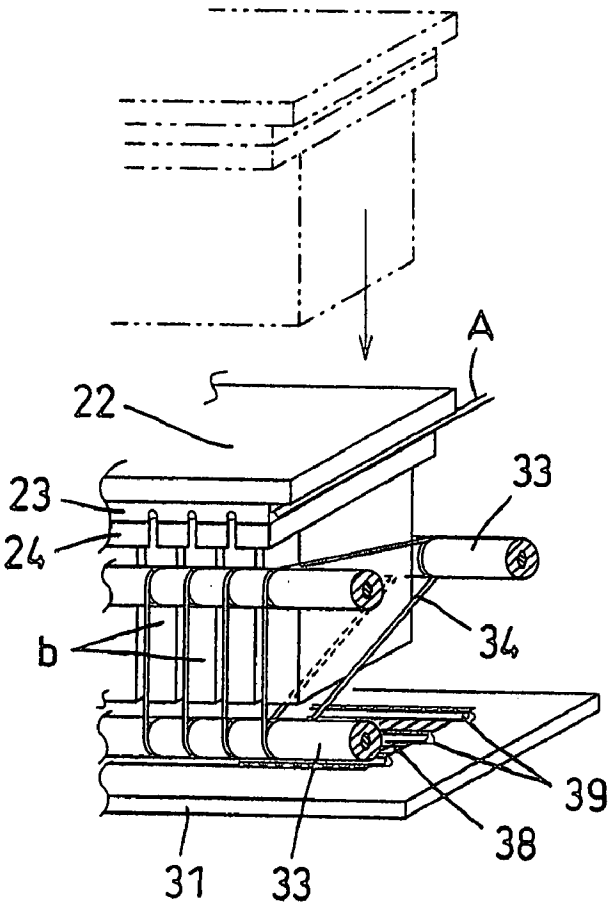
FIG. 6A is a perspective view showing a state during a workpiece cutting operation.
FIG. 6B is a perspective view showing a state upon completion of the workpiece cutting operation.
Figure 6:
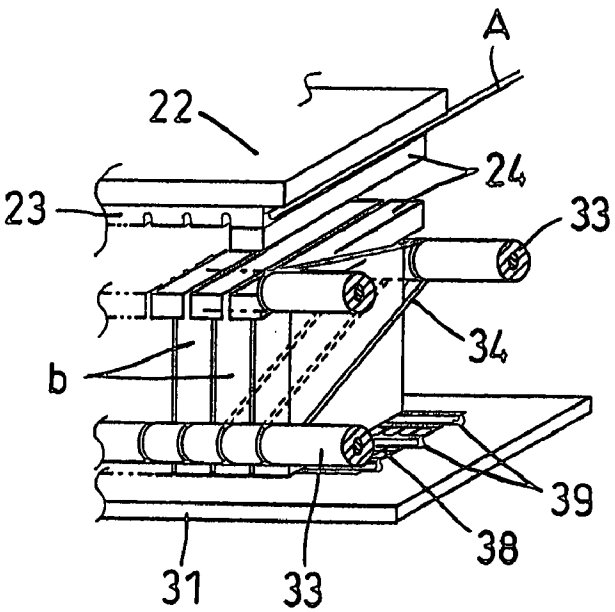

Furthermore, in the wire saw for cutting the two workpieces B at the same time, it is preferable that the receiving members 27 should be arranged on both sides such that the vertexes of the laterally isosceles triangles of the support wires 34 face each other, as shown in FIG. 2. With this arrangement, both of the upper portions of the support wires 34 are inclined toward the center, thereby preventing any interference even when the wire A is flexed downward during the workpiece cutting operation.

In the above-described cassette bottom plate 31, a hole 37 is formed within the range, in which the wafer b is supported; a mesh member 38 is stretched over the hole 37 in order to allow the slurry liquid to readily flow out; and a linear shock absorber 39 is placed on the mesh member 38, so as to elastically receive the falling wafer b and absorb a shock, thereby preventing any occurrence of breakage on the wafer b.

Incidentally, a support member in the receiving member 27 is not limited to the support wire 34 formed in the laterally isosceles triangle, as shown. For example, a single slant or horizontal wire extending in a vertical direction may be used, or a thick triangular plate having the same diameter as that of the wire A may be erected at the same pitch as that of the wire A on the cassette bottom plate 31.

Subsequently, explanation will be made on a workpiece cutting method by means of the wire saw according to the invention.

As shown in FIG. 7A, the workpiece B is fixed, with the adhesive agent 25, onto the machining mount 22 in the workpiece fixing table 20 located at an elevation position via the dummy members 23 and 24. And then, the wire A at the wire array across the work rollers 10 is allowed to reciprocate or travel in one direction at a high speed in the state in which the receiving member 27 is securely positioned above the fixing frame 26 disposed at the lower portion at the upper wire array across the work rollers 10. Thereafter, as the workpiece fixing table 20 is descended to press the wire A against the wire array, the workpiece B is cut by the wire A at the wire array, as shown in FIG. 7B. Thus, the numerous wafers b are cut out at the same time.

The tip of the cut wafer b intrudes in the upper support wire 34 located immediately under, to be guided downward in the state separated by the support wire 34. As the cutting operation proceeds, the tip of the cut wafer b intrudes in the lower support wire 34. Consequently, the posture of the wafer b is held in a partitioned state, so that the wafer b is accurately being cut without any adhesion of the wafers b to each other caused by the surface tension of the slurry liquid. In addition, as the cutting operation comes to an end, the dummy member 23 on the machining mount 22 also is cut out.

In fixing the workpiece B to the machining mount 22, the dummy member 23 fixed to the machining mount 22 and the dummy member 24 bonded to the workpiece B are brought into tight contact with each other, wherein the dummy members 23 and 24 are adhesively fixed to each other out of the range, in which the workpiece B is cut out, so that the cut portion of the dummy member 24 bonded to the workpiece B cannot reach the dummy member 23 fixed to the machining mount 22 when the dummy member 23 on the machining mount 22 also is cut out, as shown in FIG. 7C. In this manner, the cut wafer b and the dummy member 24 fall by their own weights under the guidance of the support wire 34, and thus, the lower portion is supported by the shock absorber 39 for the receiving member 27.

Before the completion of the cutting operation with respect to the workpiece B, the dummy member 24 bonded to the workpiece B is brought into tight contact with the dummy member 23 fixed to the machining mount 22, thereby preventing any occurrence of vibrations on the workpiece B during the cutting operation, so as to accurately cut the workpiece B.

As described above, upon the completion of the cutting operation, the workpiece B is cut into the wafers b in separation one from another. The wafers b are erectly partitioned and held by the support wire 34 in the receiving member 27, thereby preventing any occurrence of deformation caused by the flexure and preventing any re-adhesion of the separated wafer b to the adjacent wafer b.

In this manner, upon the completion of the cutting operation of the wafers b, the workpiece fixing table 20 is returned to the elevation position, and then, the receiving member 27 above the fixing frame 26 is taken outward from between the upper and lower wire arrays in the wire saw which has been stopped. Thereafter, the wafers b are carried to a next cleansing process as they are. Here, the wafers b may be roughly cleansed by an appropriate mechanism inside of the apparatus, as required.

The dummy members 23 and 24 are automatically detached from each other inside of the apparatus and the wafer b bonded to the dummy member 24 and the receiving member 27 are integrally taken out of the apparatus in the present preferred embodiment. However, the dummy members 23 and 24 may be taken out of the apparatus to be then detached from each other upon the completion of the cutting operation without automatically detaching the dummy members 23 and 24. In this case, the loads of the dummy members 23 and 24 and the machining mount 22 cannot exert on the wafer b as long as a support member for supporting the machining mount 22 and the dummy members 23 and 24 is disposed in the receiving member 27.

Figure 8:
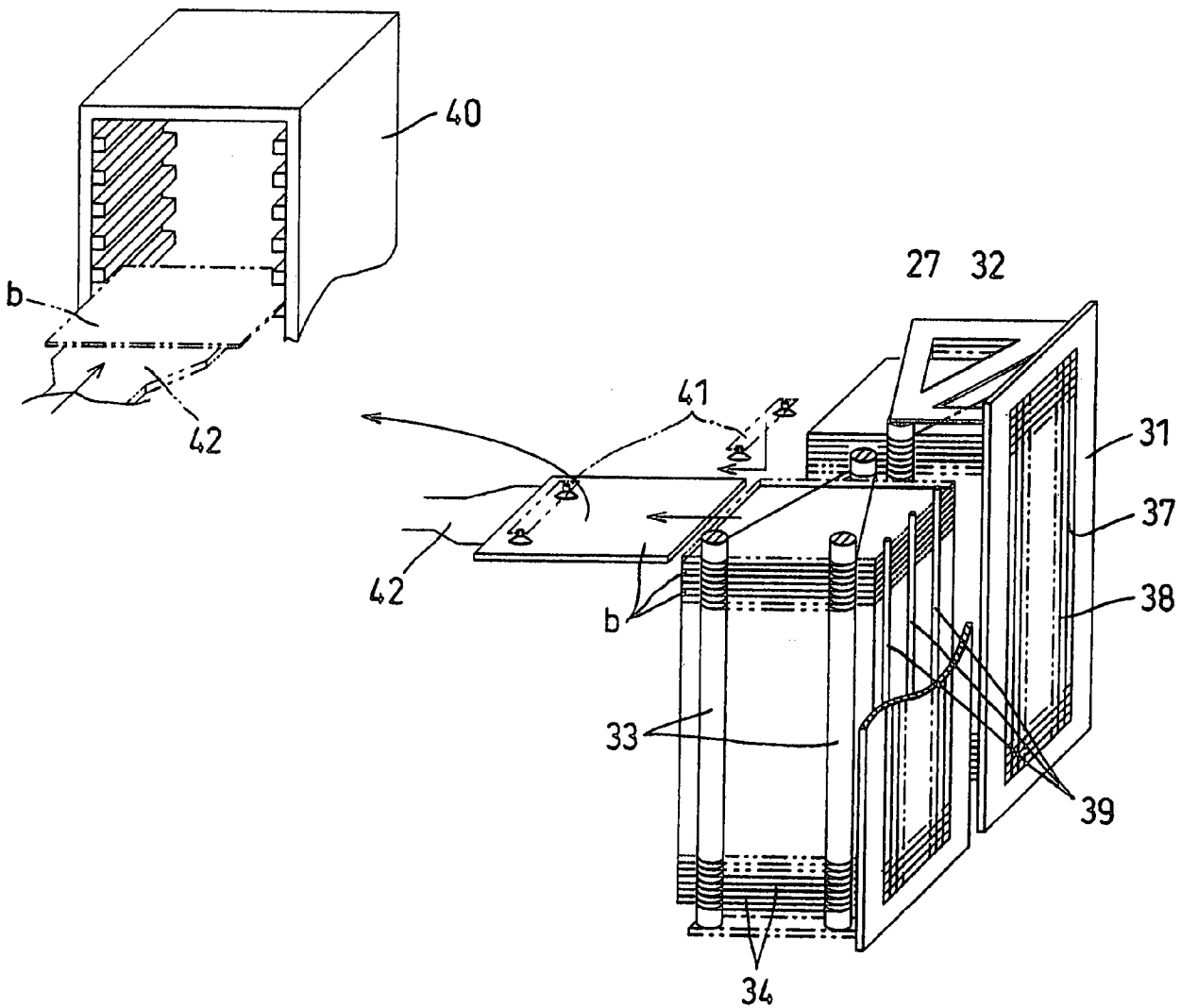
FIG. 8 is a perspective view showing a cut wafer cleansing process.
Figure 9:
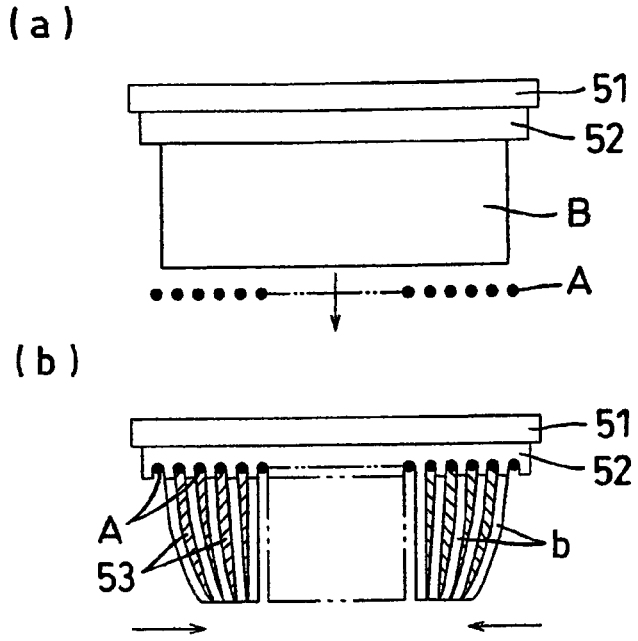
FIG. 9 PRIOR ART
FIG. 9 is a front view showing a workpiece cutting method in the prior art.

FIG. 8 shows a method for moving the wafer b onto a cleansing cassette 40 in the cleansing process. The receiving member 27, which supports the wafers b in separation one from another, is erectly disposed such that the wafers b are vertically located. Thereafter, the wafers b are taken out one by one in order from above by an adsorbing hand 41. A robot hand 42 receives the taken wafer b, and then, inserts the wafer b into the cleansing cassette 40. The wafers b can be securely cleansed by enlarging a vertical interval between the wafers b.

The wafers b are supported in separation one from another by the support wire 34 in the receiving member 27, and thus, the wafers b can be roughly cleansed in the state supported by the receiving member 27. Additionally, it is possible to facilitate a handling work when the wafer b is taken out of the receiving member 27.

Incidentally, the dummy member 24 bonded to the wafer b is designed to be peeled off by removing the adhesive agent 25 by the use of a solvent or hot water in a post process.

What is claimed is:

1. A cut workpiece receiving member in a wire saw, in which a wire array is formed by winding a wire around at least two work rollers numerous times, the wire at the wire array is made to reciprocate or travel in one direction at a high speed, and the workpiece is cut into numerous pieces of wafers in abutment of the workpiece against the wire array, the receiving member being provided at a position immediately under the wire array for cutting the workpiece, for containing the cut workpieces cut out of the workpiece by the wire in separation one from another;

the receiving member being formed by winding the same number of support wires at the same pitch as those of the wires at the wire array in the wire saw between a plurality of groove rollers mounted on a bottom plate; and the receiving member being disposed under the wire array for cutting the workpiece such that the support wires are located immediately under the wires at the wire array.

2. A cut workpiece receiving member in a wire saw according to claim 1, wherein three out of the plurality of groove rollers are arranged in a laterally triangular shape on the bottom plate, and portions above and under the support wires wound around the three groove rollers are inversely inclined.

* * * * *